US007131852B1

(12) United States Patent
Chen

(10) Patent No.: US 7,131,852 B1
(45) Date of Patent: Nov. 7, 2006

(54) RETRACTABLE PLUG OF POWER SUPPLY

(75) Inventor: Yung-Tsan Chen, Tu-Cheng (TW)

(73) Assignee: Sercomm Corporation, Taipei (TW)

( * ) Notice: Subject to any disclaimer, the term of this patent is extended or adjusted under 35 U.S.C. 154(b) by 0 days.

(21) Appl. No.: 11/215,378

(22) Filed: Aug. 30, 2005

(30) Foreign Application Priority Data

Jun. 27, 2005 (TW) ..... 94121438 A

(51) Int. Cl.
*H01R 13/44* (2006.01)

(52) U.S. Cl. ..... 439/131

(58) Field of Classification Search ..... 439/131, 439/103, 171, 172, 174
See application file for complete search history.

(56) References Cited

U.S. PATENT DOCUMENTS 2,538,296 A * 1/1951 Crocker ..... 439/172
3,025,486 A * 3/1962 Falconer ..... 439/103
3,733,576 A * 5/1973 Cooper ..... 439/103
3,926,494 A * 12/1975 Maillaro ..... 439/131
5,135,406 A * 8/1992 Ishikawa ..... 439/131
6,808,400 B1 * 10/2004 Tu ..... 439/131
2002/0127898 A1 * 9/2002 Liu ..... 439/131
2005/0130471 A1 * 6/2005 Regen et al. ..... 439/131
2005/0153588 A1 * 7/2005 Liao ..... 439/172

* cited by examiner

*Primary Examiner*—Gary F. Paumen
(74) *Attorney, Agent, or Firm*—Rosenberg, Klein & Lee

(57) ABSTRACT

A retractable plug of power supply is comprised of a slide seat and a plug body. The slide seat is snap-fastened in a housing and metal pieces are arranged on sides of the plug body. An elastic lamella is disposed above the plug body, and a wedge block is located on the elastic lamella. The housing has a slot and a positioning hook part is provided on an inner wall face of the housing. A pushbutton is combined to the elastic lamella through the slot. The plug body is slidable in the slide seat by pushing the pushbutton in order to stretch metal pieces out of the housing. The metal pieces are prevented from being withdrawn into the housing by way of mutual retaining of the wedge and the positioning hook part, and such retaining could be released by pressing down the pushbutton to allow the withdrawal of the metal pieces into the housing.

5 Claims, 6 Drawing Sheets

RETRACTABLE PLUG OF POWER SUPPLY

BACKGROUND OF THE INVENTION

1. Field of the Invention

The present invention relates generally to retractable plugs, particularly to a retractable plug of power supply, which is located at the housing of an electronic product for being stretched out or withdrawn back whenever desired.

2. The Prior Arts

Electric power is conventionally supplied to an electric product through an extension cord that connects a plug on the product with a jack that supplies electric power, or power is supplied directly by inserting a plug on the product into a jack Both ways are defective either in a liable falling off of the extension cord by a careless kick, or an unnatural appearance of the product.

Therefore, a novel thinking of this invention is aroused for dissolving the mentioned defects.

SUMMARY OF THE INVENTION

The primary objective of this invention is to provide a retractable plug of power supply, which is hidden in an electronic product for being stretched out or withdrawn back in slide movements to promote operation convenience.

A secondary objective of this invention is to provide a retractable plug of power supply, which can be fixedly stretched to prevent from being withdrawn, and can be operated easily when storing it in an electronic product is desired.

In order to realize above objectives, a retractable plug is prepared in the housing of an electronic product. The retractable plug is comprised of a combination of relatively slidable slide seat and plug body, in which the slide seat is snap-fastened in the housing, metal pieces are arranged on sides of the plug body, an elastic lamella is disposed above the plug body, and a wedge block is located on the elastic lamella. The housing has a slot and a positioning hook part is provided on an inner wall face of the housing. A pushbutton is combined to the elastic lamella through the slot. The plug body is slidable in the slide seat by pushing the pushbutton in order to stretch metal pieces out of the housing. The metal pieces are prevented from being withdrawn into the housing by way of mutual retaining of the wedge and the positioning hook part, and such retaining could be released by pressing down the pushbutton to allow the withdrawal of the metal pieces into the housing.

The merits of this invention may be summarized as the following:

(1) Since the retractable plug of this invention is accommodated inside an electronic product and it can be stretched out by way of sliding, the operation is easier and appearance of the product looks much more natural.

(2) As the retractable plug is provided with a locking function without using any springs, the assembling cost and complication can be considerably lowered.

For more detailed information regarding advantages or features of this invention, at least one example of preferred embodiment will be described below with reference to the annexed drawings.

BRIEF DESCRIPTION OF THE DRAWINGS

The related drawings in connection with the detailed description of this invention to be made later are described briefly as follows, wherein.

DETAILED DESCRIPTION OF THE PREFERRED EMBODIMENT

Figure 1:
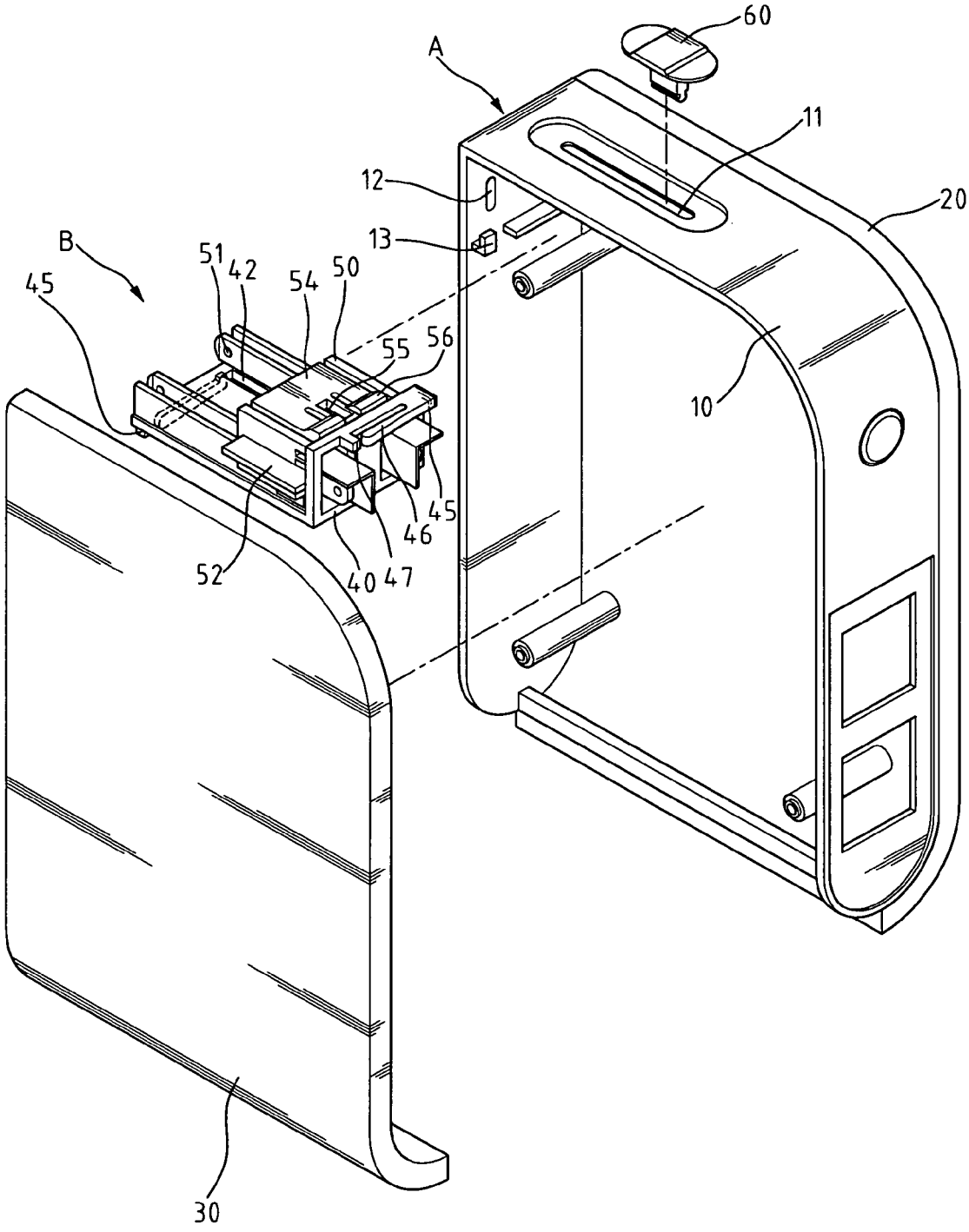
FIG. 1 is an exploded perspective view of a retractable plug of power supply in accordance with the present invention.
Figure 2:
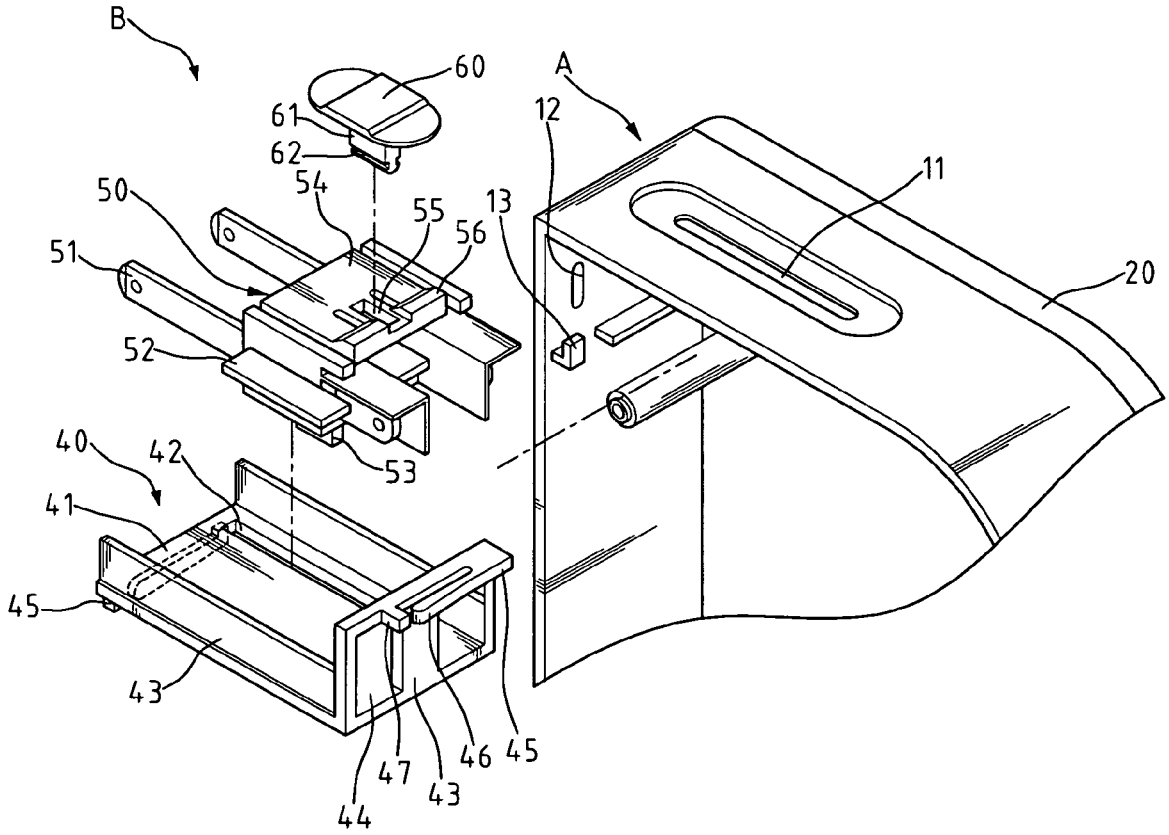
FIG. 2 is a partially enlarged view of FIG. 1.
Figure 3:
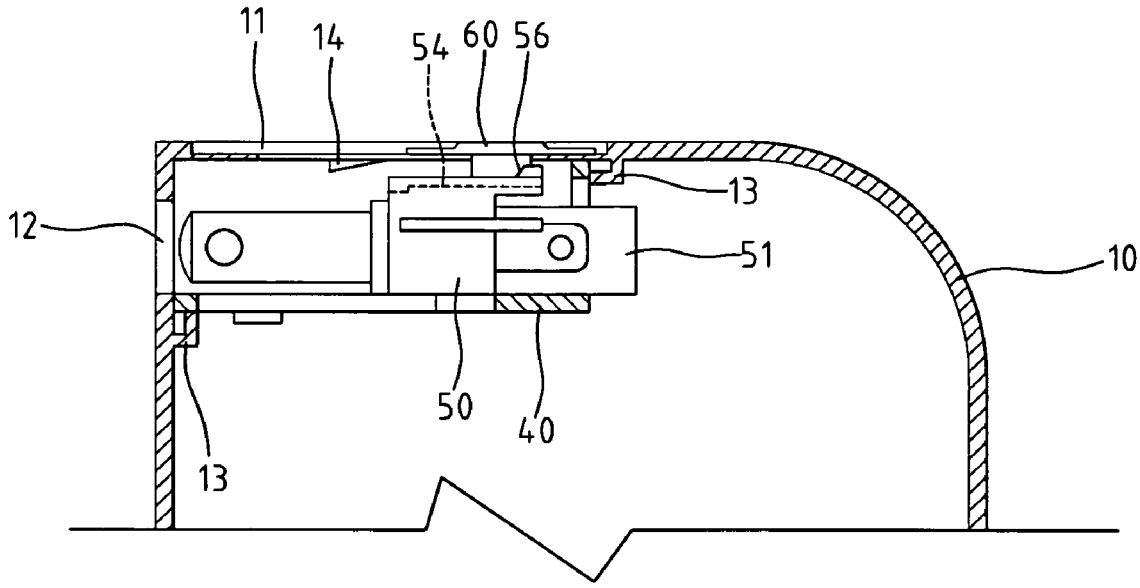
FIG. 3 is an assembled sectional view of the present invention.

As indicated in FIGS. 1–3, this invention is comprised of an electronic product A and a retractable plug B.

The electronic product A is provided with a housing 10 having a front housing body 20 and a corresponding rear housing body 30, and a slot 11 in the top face and a through hole 12 in a lateral face on respective sides thereof. There are positioning hook parts 14 arranged respectively on two sides at the front half section of the slot 11 on the inner side of the housing 10 while a positioning part 13 having an L-shaped horizontal arm and an L-shaped vertical arm is located behind the slot 11 and under the through hole 12 on the inner side of the housing 10.

The retractable plug B is comprised of a slide seat 40, a plug body 50, and a pushbutton 60. The slide seat 40 has a platform 41 formed with two groove holes 42. The platform 41 has a wall face 43 on two sides and a rear end thereof respectively, in which the wall face 43 at the rear end, which is higher than that on those two sides, is formed with two rectangular holes 44. In addition, a front edge of bottom portion of the platform 41 is associated with a top portion of the wall face 43 at the rear end to form a retaining portion 45, which is provided with an elastic element 46 having a block body 47 in the front thereof.

In front of the plug body 50, two metal pieces 51 are arranged and extended to the backside of the plug body 50 for coupling with lead wires. A wing portion 52 and protruding block 53 is disposed on those two sides and the bottom portion of the plug body 50, respectively. Also, an elastic lamella 54 is laid on the top end of the plug body 50, and formed with a groove hole 55, and provided with a wedge block 56 on two sides respectively behind the groove hole.

The pushbutton 60 is applied to combine with the elastic lamella 54, where the bottom portion of the pushbutton 60 is a fluted block 61 having a hook portion 62 formed at its front end.

Figure 5:
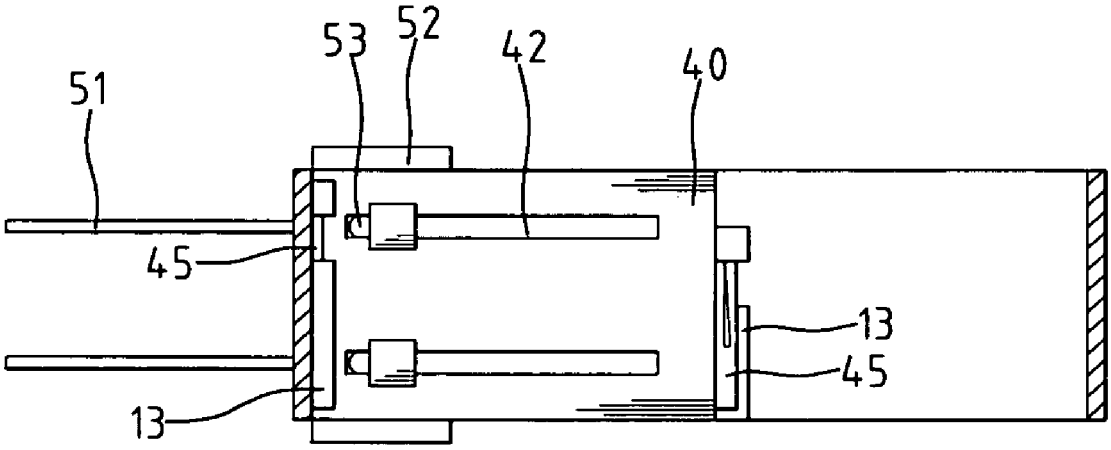
FIG. 5 is a assembled view of a slide seat and the base part of the housing according to the present invention.
Figure 6:
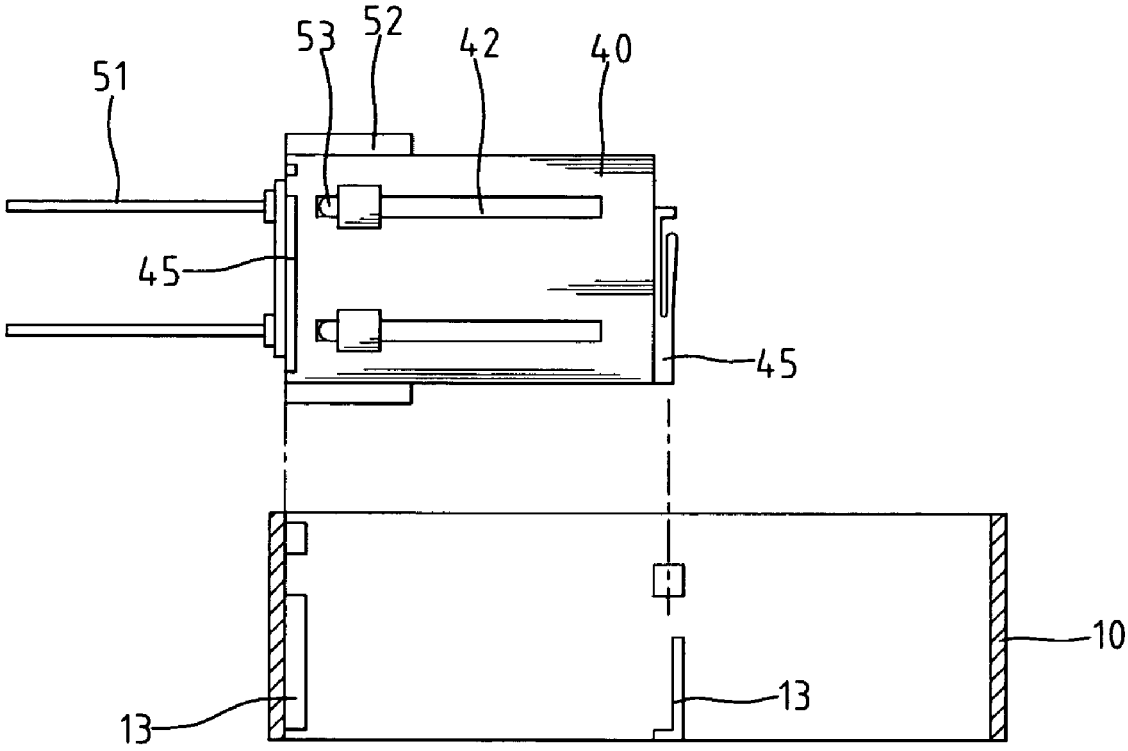
FIG. 6 is an exploded view of the slide seat and the base part of the housing according to the present invention.

Referring this time to FIGS. 3, 5 and 6 (also cf. to FIGS. 1 and 2), the plug body 50 is placed on the slide seat 40 such that the protruding block 53 of the plug body 50 is snap-fastened in the groove hole 42 of the slide seat 40 under the conditions that those two wing portions are flush with those two wall faces 43 of the slide seat 40, and meanwhile, those metal pieces 51 are correspondent with the rectangular holes 44 in the rear end face of the slide seat 40 as shown in FIGS. 5 and 6. Then, those two retaining portions 45 of the bottom portion and the rear end wall face 43 of the slide seat 40 are squeezed into the positioning parts 13 at the top face and the lateral face of the housing 10 such that the elastic element 46 and the block body 47 is fixed at the horizontal arm as well as the vertical arm of the positioning parts 13 respectively, and meanwhile, the slide seat 40 and the plug body 50 locate in the housing 10 while the groove hole 55 of the metal pieces 51 and the elastic lamella 54 of the plug body 50 are flush with the through hole and slot 11 of the housing 10. Then, the fluted block 61 of the pushbutton 60 is squeezed into the groove hole 55 of the elastic lamella 54 through the slot 11 such that the hook portion 62 of the fluted block 61 is fixed in the groove hole 55 and the retractable plug B is thereby combined to the housing 10 accordingly. Finally, The front housing body 20 and the rear housing body 30 are combined laterally with the housing 10 to complete the combination embodiment of the retractable plug B and the electronic product A.

Figure 4:
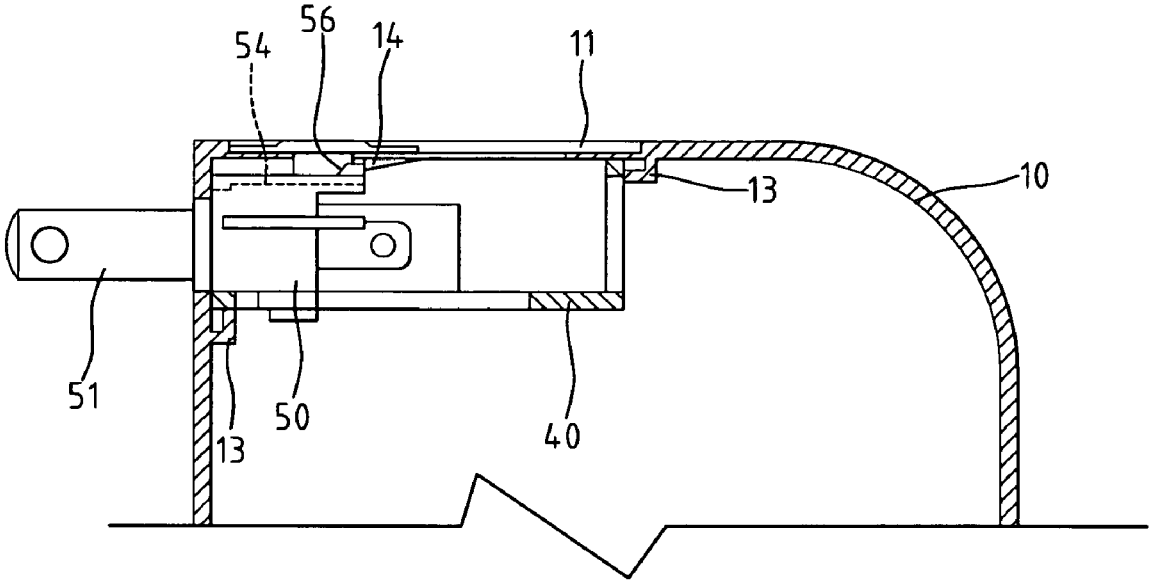
FIG. 4 is an assembled sectional view showing actions of the present invention.

As indicated in FIGS. 3 and 4 (also cf. to FIG. 2), when using this invention, a user is supposed to push the pushbutton 60 with his/her hand in order to drive the wing portion 52 and protruding block 53 to move forwards in the groove hole 42 along the lateral wall faces 43 of the slide seat 40 such that the metal pieces 51 can stretch out of the through holes 12 of the housing 10. During the displacement process of the plug body 50, the wedge block 56 may take the advantage of a slope of its own to cross over the positioning hook part 14 under the top face inside the housing until the moment the wedge block 56 crosses over the positioning hook part 14 when the wedge block 56 restores to the initial position there and then to check against the positioning hook part 14 by means of the restoring force of the wedge block itself such that the plug body 50 is forbidden to move backwards and withdraw the metal pieces back into the housing. Suppose, withdrawal of the metal pieces 51 into the through hole 12 of the housing 10 is desired, the user is requested to first press down the pushbutton 60 such that the wedge block 56 of the elastic lamella 54 on the top face of the plug body 50 would detach from the positioning hook part 14 of the housing 10, then press the pushbutton 60 backwards to drive the wing portion 52 and protruding block 53 to move backwards in the groove hole 42 along the wall faces 43 on two sides of the slide seat 40.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A retractable plug of power supply, comprising: a slot and a through hole in the housing of an electronic product; a positioning hook part in the inner wall face on sides of the slot of the housing; the plug having a plug body and a slide seat in the housing, wherein the slide seat is assembled inside the housing while the plug body, which is movably assembled to the slide seat, is provided with metal pieces at positions corresponding to the through hole of the housing and extended forwards and backwards; an elastic piece on the plug body; a wedge block on the elastic piece; a pushbutton fixed to the elastic piece through the slot of the housing.

2. The retractable plug of power supply according to claim 1, wherein a groove hole is formed in the elastic piece, a fluted block is combined to the groove hole such that the pushbutton is fixed to the elastic piece.

3. The retractable plug of power supply according to claim 1 or 2, wherein the plug is disposed at a corner in the electronic product.

4. The retractable plug of power supply according to claim 3, wherein the top face and side faces inside the housing of the electronic product are provided respectively with a positioning part; a vertical and horizontal retaining portion is arranged on sides of the slide seat, where the retaining portion is combined with the positioning part to complete the combination of the plug body with the slide seat.

5. The retractable plug of power supply according to claim 4, wherein the retaining portion has an elastic element having a block body in its front.

* * * * *